United States Patent [19]

Kenoun

[11] Patent Number: 4,526,366

[45] Date of Patent: Jul. 2, 1985

[54] ELECTRONIC WATER EJECTING GAME

[76] Inventor: Robert Kenoun, 7043 Wilson Ter., Morton Grove, Ill. 60053

[21] Appl. No.: 412,305

[22] Filed: Aug. 27, 1982

[51] Int. Cl.[3] ..... A63B 71/06

[52] U.S. Cl. ..... 273/1 GC; 273/1 E; 273/1 GE; 272/1 B

[58] Field of Search ..... 273/1 GC, 1 GE, 249, 273/253, 255, 287, 237, 311; 272/85 G, 1 B

[56] References Cited

U.S. PATENT DOCUMENTS

| | | | |
|---|---|---|---|
| 2,404,653 | 7/1946 | Plebanek | 273/311 |
| 4,113,259 | 9/1978 | Sands | 273/287 |
| 4,285,517 | 8/1981 | Morrison | 273/1 GC |
| 4,309,030 | 1/1982 | Goldfarb et al. | 273/1 E |

*Primary Examiner*—Richard C. Pinkham

*Assistant Examiner*—Mary Ann Stoll

[57] ABSTRACT

A competitive game is disclosed in which the competitors spray each other with water, and which is therefore well suited for outdoor recreational activity in hot weather. The players operate switches to attack each other by means of spray nozzles, and also to defend themselves against such attacks. The defender, if his or her reaction to a warning light is quick enough, can abort the attack entirely. He or she can also divert it to another player. The game accommodates four players who can team up in various combinations to attack and defend in concert, the combinations being determined by a sophisticated Boolean function which is programmed into the game's logic. The game is also playable in a rotated mode which rescrambles the Boolean function to present a different set of strategy considerations.

13 Claims, 5 Drawing Figures

FIG 1
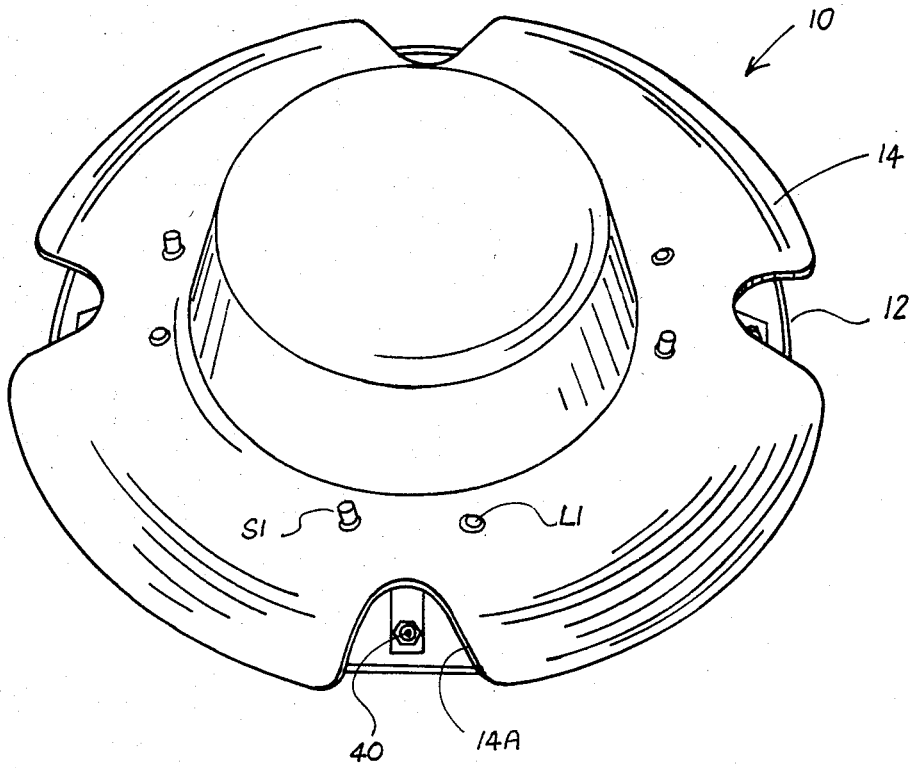
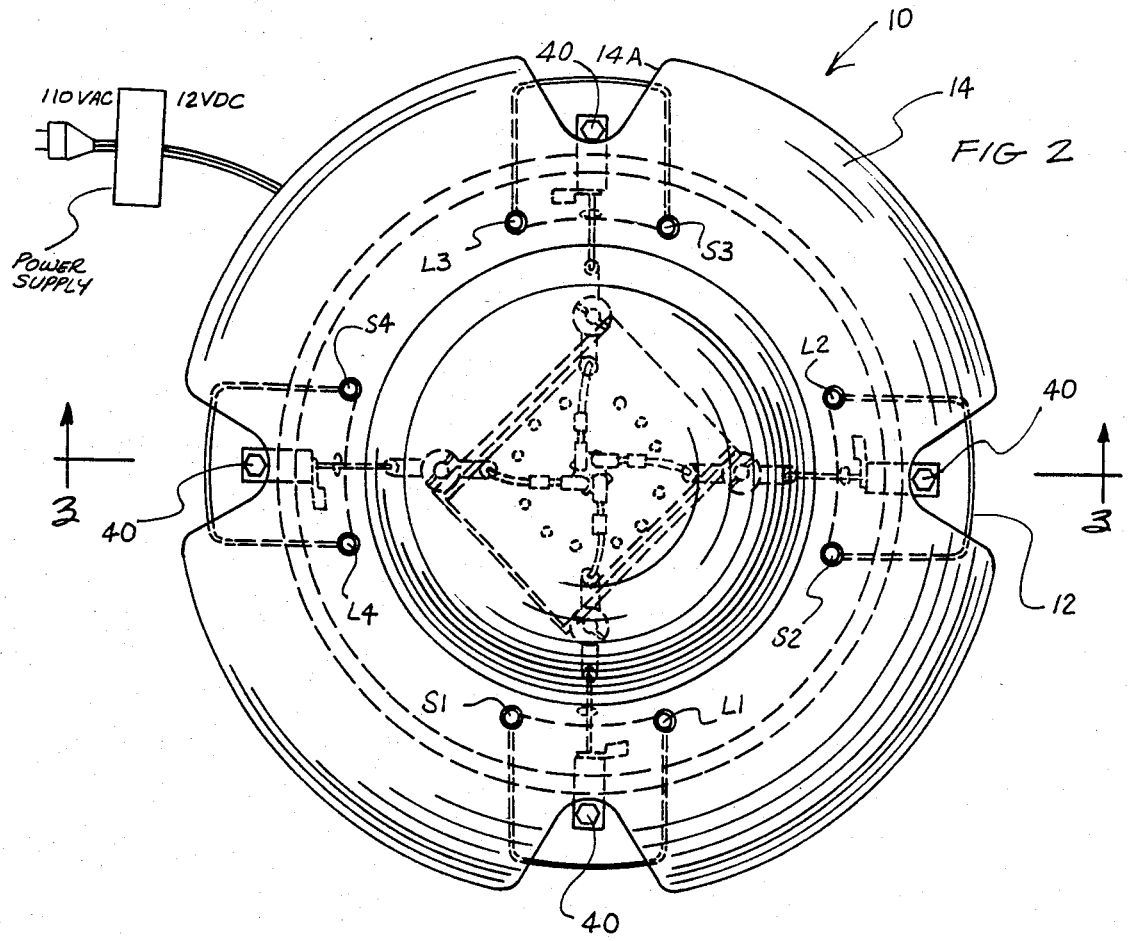
FIG 2

ELECTRONIC WATER EJECTING GAME

This invention relates generally to games, and particularly concerns a competitive game requiring quick reactions, rapid strategy calculations, and teamwork.

BACKGROUND OF THE INVENTION

The prior art is familiar with competitive water-spraying games which are suitable for outdoor play by children or adults who are wearing bathing suits or old clothes. Such games have the advantage of cooling the players during uncomfortably hot weather.

The present game is of that general type, but it offers an entirely different set of strategy considerations from any games hitherto known, as well as providing a stringent test of the players' reaction times and of their ability to coordinate team efforts under trying conditions.

BRIEF SUMMARY OF THE INVENTION

In accordance with one aspect of the present invention, a game which is adapted to be played by at least one player comprises means for ejecting fluid toward a player, indicator means for displaying game information to the player, means arranged to determine a set of game rules, the game-rule-determining means including logic means operable to control the indicator means, and manually operable means adapted to be actuated by the player (acting in response to said game information) for sending information to the logic means according to the game rules. The logic means are arranged to cause the ejecting means to eject fluid toward the player when he or she fails to activate the manually operable means according to the game rules.

In accordance with another aspect of the invention, referred to herein as the "abort" feature, the game is adpated to be played by a plurality of players located at respective different positions, including an attacking position and a defending position. There is a means for attacking a defending player (located at the defending position) when such attacking means receives a delayed attack signal. There is a means operable to initiate a delay interval upon receiving an attack signal, and thereafter to send a delayed attack signal to the attacking means at the end of the delay interval. First switch means is positioned to be operated by an attacking player, located at the attacking position. There is a means which is operable in response to actuation of the first switch means for sending an attack signal to the delay interval means. A further means is provided which is responsive to the attack signal, and positioned to warn the defending player (at the defending position) of the impending attack. A second switch means is positioned to be operated by the defending player at the defending position. And further means is provided for disabling the attacking means, the disabling means being operable in response to actuation of the second switch means. Accordingly, the attack is aborted if the second switch means is actuated before the expiration of the delay interval.

Thus the attacking player may use his or her switch means to initiate an attack sequence directed at the defending player. When the attacking player does this, he or she initiates a delay interval and simultaneously issues a warning to the defending player. If the defending player reacts by operating his or her own switch means before the delay interval expires, he or she can abort the attack. If he or she does not, the attack is successful. Since the delay interval is not very long, this provides a stringent test of the defending player's reaction speed.

In a further elaboration of the "abort" mode, there are at least three player positions angularly displaced from each other and each having respective attacking means, delay interval means, switch means, and warning means. The game is arranged so that the warning means and attacking means are rotatable through an angular displacement of at least one player position relative to each other without disrupting the operating relationships between the warning means and the switching means, so that the warning may be directed toward a different player position than the attack.

When played in this "rotated" mode, the game requires the player who receives the warning and the player who is under attack to cooperate with each other. The player who receives the warning must quickly relay it to the player under attack, in time for the latter to employ his or her switch means before the delay interval expires.

In a further elaboration of the "rotated" mode, there are four player positions angularly displaced from each other and each having a respective attacking means, delay interval means, switch means, and warning means. The game is arranged so that the warning means and attacking means are rotatable through an angular displacement of at least two player positions relative to each other without disrupting the operating relationships between the warning means and the switching means. Therefore not only is the warning directed toward a different player position from the attack, but that different player position may be as far away as diametrically opposite the player position toward which the attack is directed.

This "diametrically rotated" mode requires those players who are diametrically oppositely positioned to pair off in teams: i.e. north/south versus east/west.

In accordance with another aspect of this invention, referred to herein as the "diversion" feature, once again the game is adapted to be played by a plurality of players located at respective different positions, including at least one attacking position, at least one defending position, and at least one additional position.

There are at least two attacking means. A first one of the attacking means is operable in response to an attack signal, and is positioned for attacking the defending player located at the defending position. A second attacking means is operable in response to the attack signal, and is positioned for attacking an additional player located at the additional position.

First switch means is positioned to be operated by an attacking player (located at the attacking position), and the attacking means is operable in response to operation of the first switch means. Second switch means is positioned to be operated by the defending player (at the defending position).

Logic means is provided for routing the attack signal to the first attacking means in response to operation of only the first switch means, so that the attack is initially directed at the defending player at the defending position. The logic means is also arranged, however, to divert the attack signal from the first to the second attacking means in response to concurrent actuation of the first and second switch means, so that the attack is diverted from the defending position to the additional position when the second switch means is also actuated.

In this version of the game the defending player can divert the attack to another player, thus assuming the offensive himself instead of merely taking defensive action. The game in this form leads to a long sequence of diverted and rediverted attacks, requiring strategic calculations while under competitive pressure.

In a further elaboration of the "diversion" mode, the game further comprises third switch means positioned to be operated by the additional player at the additional position, and the logic means is arranged so that concurrent actuation of the first, second and third switch means is by itself ineffective to terminate or divert the attack from the additional player to any other player.

In the above form the game is preferably adapted to be played by at least first through fourth players located at first through fourth positions respectively, and it comprises at least first through fourth attacking means arranged for attacking the first through fourth players respectively located at the first through fourth positions respectively in response to an attack signal. At least first through fourth switch means are arranged to send the attack signal, and are positioned at the first through fourth positions respectively in order to be operated by the first through fourth players respectively.

Logic means is arranged to route the attack signal to the attacking means in response to operation of the switch means, the logic means being so arranged that any player who is under attack by two adjacent players is required to cooperate with the fourth player to terminate the attack or divert it from himself to one of the original attackers.

The logic conditions for achieving this and other interesting cooperative patterns of attack and counterattack are as follows: the attacking means must attack the first through fourth players 1 through 4 respectively in response to actuation of the first through fourth switches S1 through S4 respectively according to the following Boolean expressions:

1=not S1, not S3, S4+not S2, S3, S4

2=S1, not S3, S4+S1, not S2, not S4

3=not S1, S2, not S3+S1, S2, not S4

4=not S1, S2, S3+not S2, S3, not S4.

The "diversion" mode also produces interesting results when the "rotation" mode is superimposed thereon. Thus, in another of its aspects the invention contemplates a game of the "diversion" type wherein the positions are angularly displaced from each other and the game is arranged so that the warning means and attacking means are rotatable through an angular displacement of at least two player positions relative to each other without disrupting the operating relationships between the warning means and the switching means, so that the warning may be directed toward a different player position than the attack.

This variation requires cooperation between teams comprising players located at diametrically opposed positions to terminate of divert any attack on either one of them.

Preferably the invention combines the "abort" and "diversion" features in one game. Such a game has the "diversion" feature outlined above, and further comprises means, for each of the attacking means, operable to initiate a delay interval and thereafter to send a delayed attack signal to its respective attacking means at the end of the delay interval. Each of the delay means is connected to initiate its respective delay interval in response to the attack signal for its respective attacking means. There is a means responsive to the attack signal, and which is positioned to warn the player at the position under attack. Respective disabling means are provided for disabling each of the attacking means, these disabling means being operable in response to actuation of the respective switch means corresponding to the addressed attacking means. Thus the attack is aborted if the latter switch means is actuated before the expiration of the delay interval.

In this form the game combines the capacity to abort the attack through quick reacton to the warning means, and the capacity to divert it to another victim instead of merely taking defensive action. Stated another way, it gives each player the capability of avoiding attack altogether, as well as of shunting the burden of response to another player.

In its most preferred form, the game superimposes the "rotation" feature upon both the "abort" feature and the "diversion" feature. In this variant the game is similar to that just outlined, except that the positions are angularly displaced from each other and the game is arranged so that the warning means and attacking means are rotatable through an angular displacement of at least two player positions relative to each other without disrupting the operating relationships between the warning means and the switching means, so that the warning may be directed toward a different player position than the attack.

In this form the game exhibits both the quick-reaction abort feature and the attack-diverting feature, plus the option of organizing the players into teams comprising diametrically opposed pairs (north/south versus east/west) who must cooperate with each other with great rapidity in order to take advantage of the abort feature, and/or to rescue each other from concerted attack by the other team.

The invention also contemplates that the "rotation" feature can be achieved by electrical switching, without the need for any actual physical turning of the game apparatus. According to this aspect of the invention, the game comprises a plurality of alternative rule-determining logic circuits, and selection among these alternatives is accomplished by electrical switching means.

These and other features, objects and advantages of the invention will now be more fully described in connection with a particular embodiment. This embodiment serves to illustrate the invention, but the invention is not limited thereto. The detailed description of this illustrative embodiment is intended to be read in conjunction with the following drawings, in which like reference characters refer to like elements throughout the several figures:

BRIEF DESCRIPTION OF THE DRAWINGS

FIG. 1 is a perspective view of an apparatus designed for playing a game in accordance with the present invention.

FIG. 2 is a top plan view of the apparatus of FIG. 1.

DETAILED DESCRIPTION OF THE PREFERRED EMBODIMENT

Mechanical Hardware

Figure 3:
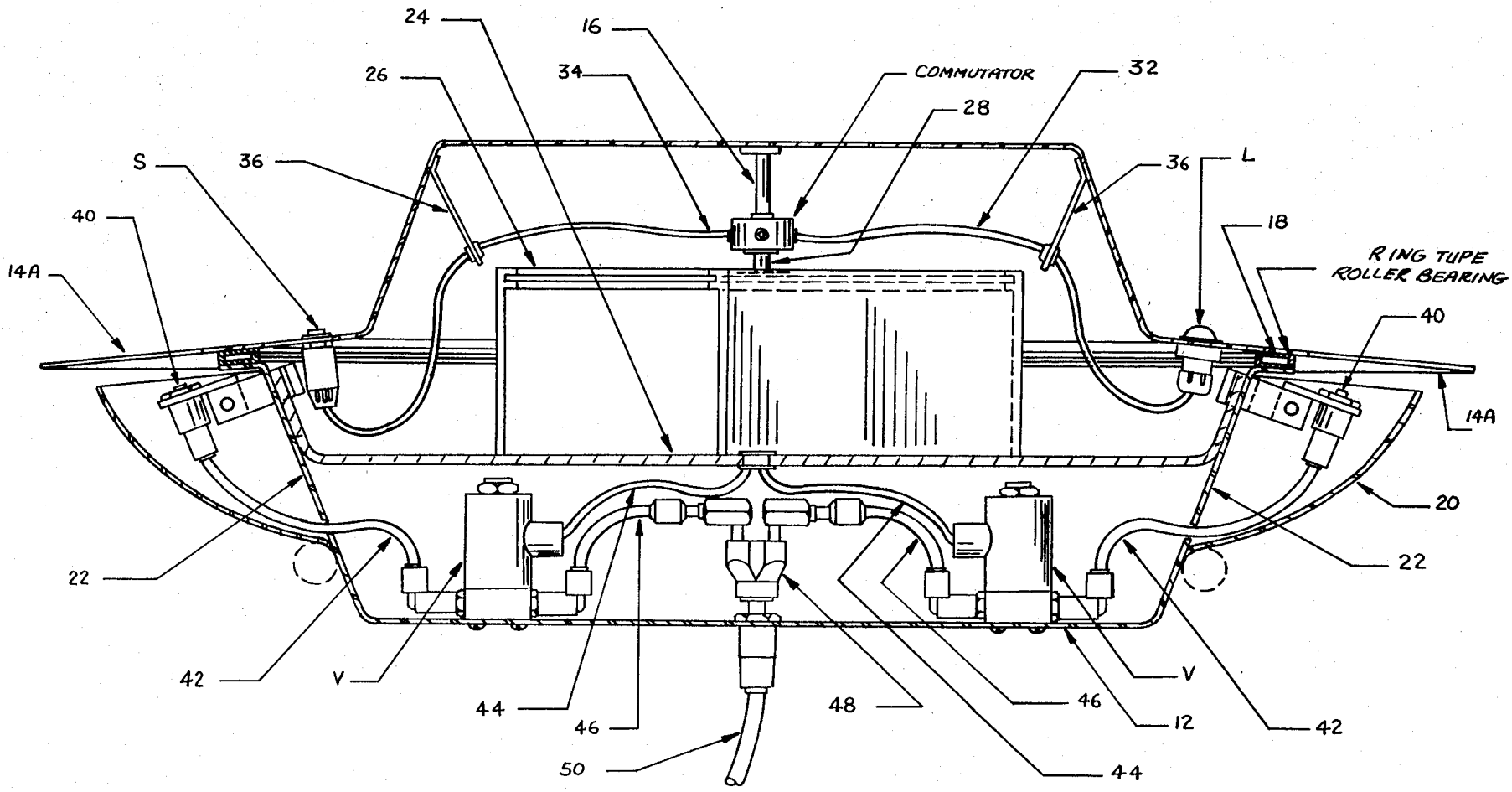
FIG. 3 is a sectional view of the apparatus, taken along the lines 3—3 of FIG. 2.

As seen in FIGS. 1 through 3, the apparatus for playing the game of this invention is indicated generally by reference numeral 10. It comprises a generally circularly shaped stationary base 12 adapted to sit upon a flat surface, and a generally circularly shaped turret 14 which overlies the base and is rotatable relative thereto. The turret is rotatably supported upon the base by an upright shaft 16 and a ring-shaped roller bearing 18.

The assembly of the base 12 comprises a lower pan member 20 of generally circular shape which serves as the foundation of the base assembly. At four equally angularly spaced intervals around the generally circular periphery of the pan member 20 the wall of the pan member is struck radially inwardly from the remainder of the wall to form support members 22 recessed from the otherwise circular periphery. Supported upon these members 22 is a deck 24 and the ring-shaped roller bearing 18.

The deck 24 in turn supports a rectangular electronics cabinet 26, upon which rests a hollow but rigid conduit 28. The latter contains a plurality of electrical leads (not visible in the drawing) which issue from the electronics cabinet 26 and are connected to various electrical components (not illustrated) within the cabinet. The conduit terminates at its upper extremity in an electrical commutator 30 which has stationary commutator rings that are electrically connected to the leads within the conduit. The uprigth shaft 16 in turn rests upon the commutator.

A plurality of electrical leads 32 and 34 are electrically connected to rotating segments of the commutator 30. These leads issue from the commutator and lead to respective electrical lights L and electrical switches S mounted upon the rotatable turret 14. Hangers 36 are suspended from the underside of the turret in order to support the leads 32 and 34. The conduit 28, the electrical leads therewithin, and the stationary rings of commutator 30 are all non-rotatable relative to the electronics cabinet 26 and the rest of the base assembly 12.

The rotating segments and outer housing of the commutator rotate relative to the conduit 28. The electrical leads 32 and 34, the upright shaft 16, and the turret 14 are all affixed to the outer housing of the commutator, and rotate along with the commutator housing relative to the base 12. The commutator maintains continuous electrical continuity between the leads 32, 34 and their respective connecting leads within the conduit 28 during such rotation, in order to avoiding disrupting the electrical connection of lights L and switches S to the circuitry within the electronics cabinet 26.

Mounted upon respective support members 22 are a plurality of liquid spray nozzles 40 which are aimed to spray fluid through respective cut-outs 14A formed in the turret 14. These nozzles are supplied with fluid by respective lengths of tubing 42. The fluid flow is controlled by respective solenoid-actuated valves V which are under the electrical control of respective lead wires 44 issuing from the underside of the electronics cabinet 26 and deck 24. Fluid is supplied under pressure to each of the valves V through respective individual supply lines 46 connected to a manifold 48, which in turn is fed by a main supply line 50.

The valves and plumbing just described are all enclosed within the base 12. The main supply line enters this enclosure through an opening in the bottom wall of the base. The flat surface upon which the game 10 rests should therefore be provided with an appropriate access opening to accommodate the main supply line 50.

The fluid employed could by any harmless gas or liquid introduced under moderate pressure through the main supply line. In a preferred embodiment, the fluid employed is a liquid such as ordinary tap water, obtained under sufficient pressure by suitably couping the main supply line 50 to a home faucet. The players are therefore sprayed with water during the course of play, which makes the game ideal for cooling off during uncomfortably hot weather.

As best seen in FIGS. 1 and 2, the preferred embodiment of the game is adapted for play by four individuals, each of whom sits directly in front of a respective one of the nozzles 40 so that he or she can be "attacked" by means of a water spray whenever the associated valve V is actuated by electrical circuitry. In this position, each player is also able to view a respective one of four lights L1 through L4 and to operate a respective one of four switches S1 through S4 located directly in front of him or her. Note that the lights L and switches S protrude upwardly through the turret 14, and are located adjacent to respective turret cut-outs 14A so as to be viewable and operable by the player at whom the nearby nozzle 40 is directed.

Electrical Circuitry

Figure 4:
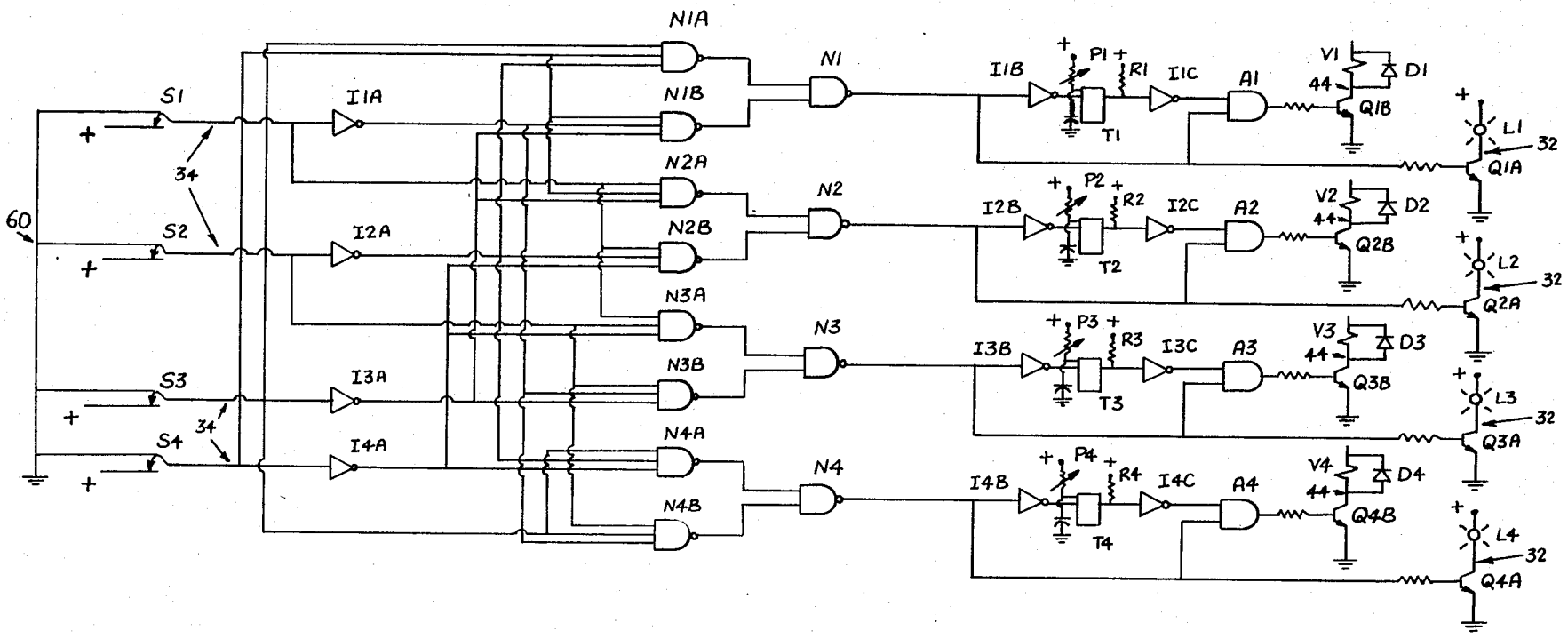
FIG. 4 is a schematic circuit and logic diagram of the electronic circuitry of the game of the preceding figures.

FIG. 4 illustrates the electrical circuitry and logic contained within the cabinet 26. The logic circuitry which determines the playing rules for this game is indicated by the reference numeral 59. Switches S1 through S4 are all of the single pole, double throw type; and are biased toward a pole which is grounded (corresponding to logic level ZERO) by means of a common line 60. When any one of the switches S is operated, it is momentarily transferred to its opposite pole which is supplied with a positive voltage that corresponds to logic level ONE.

The transferrable contacts of switches S1 through S4 are connected to the inputs of a group of first inverters I1A through I4A respectively, and are also connected in a selected pattern to various inputs of a group of three-input first nand gates N1A and N1B through N4A and N4B. The outputs of the first inverters are also connected in a selected pattern of various inputs of those first nand gates. The outputs of the latter gates are connected in pairs to the inputs of a group of two-input second nand gates N1 through N4.

Logic

Each first and second nand gate produces a logical ZERO output only when all of its inputs are logical ONES; otherwise it always produces a logical ONE output. The truth table for each three-input nand gate is:

| Input | | | Output |
|---|---|---|---|
| 0 | 0 | 0 | 1 |
| 0 | 0 | 1 | 1 |
| 0 | 1 | 0 | 1 |
| 0 | 1 | 1 | 1 |
| 1 | 0 | 0 | 1 |
| 1 | 0 | 1 | 1 |
| 1 | 1 | 0 | 1 |

-continued

| Input | | | Output |
|---|---|---|---|
| 1 | 1 | 1 | 0 |

The truth table for each two-input nand gate is:

| Input | | Output |
|---|---|---|
| 0 | 0 | 1 |
| 0 | 1 | 1 |
| 1 | 0 | 1 |
| 1 | 1 | 0 |

The most readily understandable way to comprehensively describe the overall result achieved by the logic employed herein is by means of the following overall truth table:

| | S1 | S2 | S3 | S4 | N1 | N2 | N3 | N4 |
|---|---|---|---|---|---|---|---|---|
| 1 | 0 | 0 | 0 | 0 | 0 | 0 | 0 | 0 |
| 2 | 0 | 0 | 0 | 1 | 1 | 0 | 0 | 0 |
| 3 | 0 | 0 | 1 | 0 | 0 | 0 | 0 | 1 |
| 4 | 0 | 0 | 1 | 1 | 1 | 0 | 0 | 0 |
| 5 | 0 | 1 | 0 | 0 | 0 | 0 | 1 | 0 |
| 6 | 0 | 1 | 0 | 1 | 1 | 0 | 1 | 0 |
| 7 | 0 | 1 | 1 | 0 | 0 | 0 | 0 | 1 |
| 8 | 0 | 1 | 1 | 1 | 0 | 0 | 0 | 1 |
| 9 | 1 | 0 | 0 | 0 | 0 | 1 | 0 | 0 |
| 10 | 1 | 0 | 0 | 1 | 0 | 1 | 0 | 0 |
| 11 | 1 | 0 | 1 | 0 | 0 | 1 | 0 | 1 |
| 12 | 1 | 0 | 1 | 1 | 1 | 0 | 0 | 0 |
| 13 | 1 | 1 | 0 | 0 | 0 | 0 | 1 | 0 |
| 14 | 1 | 1 | 0 | 1 | 0 | 1 | 0 | 0 |
| 15 | 1 | 1 | 1 | 0 | 0 | 0 | 1 | 0 |
| 16 | 1 | 1 | 1 | 1 | 0 | 0 | 0 | 0 |
| | S1' | S2' | S3' | S4' | N3 | N4 | N1 | N2 |

In this table, for example, line 13 indicates that when switches S 1 and S2 are actuated to produce respective logical ONE outputs, and switches S3 and S4 are not actuated, so that their outputs are logical ZEROS, then the second nand gates N1, N2 and N4 are all producing logical ZERO outputs and the second nand gate N3 is producing a logical ONE output.

(For the moment the reader should ignore the labels at the bottom of the overall truth table.)

The results of the overall truth table can be summarized by the following Boolean expressions:

N1=not S1, notS 3, S4+not S2, S3, S4

N2=S1, notS 3, S4+S1, not S2, not S4

N3=not S1, S2, not S3+S1, S2, not S4

N4=not S1, S2, S3+not S2, S3, not S4.

The Attack Sequence

Each time one of the second nand gates N1 through N4 produces a logical ONE output, a high voltage is applied to an associated one of four first NPN transistors Q1A through Q4A, thus turning on the associated one of the lights L1 through L4. At the same time, an associated one of four two-input AND gates A1 through A4 is enabled, and an associated one of four second inverters I1B through I4B causes a ground level to be supplied to an associated one of four timer circuits T1 through T4, which causes the selected timer to start its timing cycle. The light L warns the relevant one of the four players that he or she will be attacked as soon as the timing cycle of the relevant one of the timers T1 through T4 has terminated.

The timers T are preferably standard off-the-shelf integrated circuits, and all four of them may even be located upon a single commercially available integrated circuit chip, such as part number NE558, a standard quadruple timer available from Radio Shack stores and other sources. The four timers are provided with respective external potentiometers P1 through P4 which permit indiivdual adjustment of the length of the timer delay intervals.

Normally the output terminals of the timers T draw current through respective resistances R1 through R4, thus clamping the input voltage to each one of four third inverters I1C through I4C at a low (logical ZERO) level. As a result, the outputs of the third inverters are high, and a group of AND gates A1 through A4 are continuously enabled thereby. But of course such enablement normally goes for naught, because at this time there is no attack signal available at the other AND gate input from the associated nand gate.

When the attack signal is issued by one of the nand gates, then the timer temporarily deprives the AND gate of its enabling input. During the delay interval the timer output terminal voltage goes high (logical ONE) temporarily, causing the inverter output to go low (logical ZERO) temporarily, and thus disabling the AND gate for the moment. It is only after the delay interval is over that the initial conditions of the timer and inverter are restored, thus re-enabling the AND gate, and allowing the attack signal from the nand gate to pass through the AND gate.

When the attack signal passes through one of the AND gates, the appropriate one of four second PNP transistors Q1B through Q4B is driven to activate the coil of the associated one of the four solenoid-actuated valves V1 through V4. (The coils are shunted by protective diodes D1 through D4 respectively.) The selected solenoid-actuated valve then opens to spray water at the player who sits in front of the associated one of the nozzles 40. Thus, at the end of the timer delay interval, the player under attack will be sprayed with water, unless he or she can do something to change the output of the associated two-input nand gate N1 through N4.

The Abort Feature

But the player under attack is not helpless. In addition to the light L which warns him or her of the impending attack, he or she has at his or her playing position one of the four switches S1 through S4. The key to the playing of the game lies in the offensive and defensive use of such switches by the competing players.

To understand the multi-faceted use of these switches, note the overall truth table set forth above. Each time a player actuates his or her own switch, and no other switch is actuated, some other player's position is attacked. For example, line 9 tells us that if player 1 actuates his or her own switch S1 and the other players do nothing, then nand gate N2 produces a ONE output, and therefore player 2 comes under attack. If player 2 does not react at all, he or she will be sprayed with water at the end of the delay interval of his or her timer T2, and the spray will continue for a period equal to the output interval of that timer.

But if player 2 actuates his or her own switch S2, nand gate N2 no longer produces a ONE output, and player 2 is no longer under attack; see line 13 of the overall truth table. If player 2 reacts to his or her warning light L2 within the delay interval of his or her timer T2, the attack will be entirely aborted, because by the time the output of the timer T2 arrives at the AND gate A2, the latter will no longer be enabled, owing to the intervening change in the output of the nand gate N2 from ONE to ZERO. Thus the player initially under attack will not be sprayed at all.

A suggested timer delay interval for normal play is about 0.68 seconds. This poses a fairly stringent test of the victim's reaction time, but is nevertheless long enough to give most individuals a fair chance to abort the attack. If that interval should prove too long or too short, however, it can be adjusted by means of the potentiometers P1 through P4.

The Handicap Feature

Moreover, the delay intervals for different players can be individually tailored to their respective skill levels and reaction times by differential adjustment of the different potentiometers P1 through P4. Thus the game can be played on a weighted handicap basis to balance out different levels of ability, and thus even out the competition.

The Diversion Feature

The truth table tells us that the attacked player's defensive use of his or her switch S has offensive as well as defensive consequences. Moreover it has three offensive consequences regardless of whether or not the victim reacts in time to abort the spray intended for him or her. Thus whenever player 2 operates his or her switch S2, he or she diverts the valve-actuating second nand gate output (the "attack signal") to player 3. If player 1 is still attacking by continuing to operate his or her switch S1, then the combination of switches S1 and S2 operated concurrently (line 13 of the overall truth table) will divert the attack to player 3 by diverting the attack signal to the output of nand gate N3. Even if player 1 in the meantime releases his of her switch S1, line 5 of the truth table shows that player 3 comes under attack by player 2.

The Team Aspect

The abort and diversion features become much more complex, and thus pose a stringent test of ones ability to think strategically under the pressure of an attack, when the players form cooperating pairs to attack another player in concert. When that happens, in general the victim acting alone cannot take advantage of the abort and diversion features, and is therefore required to form a defensive alliance with the fourth player in order to protect himself. Just how the team pairings work depends upon which of several rotation positions of the turret 14 is employed. Thus the team aspect will be explained in the context of specific rotation modes.

The Rotation Feature

There are two principal modes of playing this game: straight, and reversed. In the straight mode the turret is in what we may call its home position, which is the one illustrated in the drawings; i.e. it is positioned so that each light L which is activated is at the same compass position as the valve V which is activated along with that particular light. In other words the player under attack from his or her valve V is also the one who is warned by the light L directly in front of him or her.

But that is not the case when the turret 14 is rotated relative to the base 12 by one, two, or three quarter-turns. When the turret is turned any number of quarter-turns, in general the activated light L is displaced relative to the activated valve V, so that the warning represented by the activated light is given to some player other than the one who is under attack by the activated valve; a circumstance which complicates the game and calls for cooperation between the player under attack by the valve V and the player who receives the diverted warning from the displaced light L.

In particular, in the "reversed" playing mode the turret is rotated 180 degrees from the home position, with the result that each player receives a warning light only when the player at the compass heading directly opposite him or her is under attack. This is an operating mode which requires the players to pair up as north-south and east-west teams. This is the most interesting of the rotated modes.

Straight Mode: Turret in Home Position

Single Attack: In this mode each player acting alone can attack only the next "higher" numbered position; i.e. S1 attacks L2/V2 (see line 9 of the overall truth table), S2 attacks L3/V3 (see line 5), S3 attacks L4/V4 (line 3), and S4 attacks L1/V1 (line 2). ("Higher" is used here in a "ring counter" sense. The count is modulo four with no carries to a higher power of the base four; therefore after "four" the next "higher" count is one, and the cycle is endlessly recapitulated.)

Counterattack by Victim: If S1 is attacking L2/V2 and player 2 counterattacks by actuating his or her switch S2, then L3/V3 comes under attack instead of L2/V2 (see overall truth table line 13). In general, whenever player X attacks player X+1, and X+1 counterattacks, the attack is diverted to X+2.

Concerted Attack by Adjacent Pair: When two adjacent players attack in concert, the attack is directed to the next "higher" numbered player; e.g. S1 and S2 together attack L3/V3 (line 13), and in general player X and X+1 together attack player X+2. If L3/V3 is under attack by S1 and S2 acting in concert, player 3 can not counterattack by using switch S3; because truth table line 15 shows that his or her valve V1 will continue to be activated. He or she must turn to another player for help. In general, if a player is under attack by two players who are adjacent to each other, he or she cannot counterattack without help from the remaining player.

The only way valve V3 can be deactivated while S1 or S2 are both on is for player 4 to actuate his or her switch S4. When he or she does that, the attack is terminated (truth table line 16) if switch S3 is still actuated, or is diverted back to L2/V2 if player 3 chooses to open his or her switch S3 (line 14). And line 10 of the truth table shows that player 2 cannot respond to this diversion of the attack by releasing his or her switch S2, as long as S1 and S4 remain on and S3 is off. Then player 2 is now the one who needs outside help.

Alternatively, player 3 can be rescued by player 1 if the latter releases his or her switch S1 while S2 and S3 are both on. This diverts the attack to L4/V4 (line 7), thus giving player 4 an incentive to rescue player 3 before player 1 does.

But player 3 can be rescued by player 1 only if player 3 holds his or her switch S3 closed, since the opening of S1, while S2 remains closed and S3 is open, will sustain the attack upon L3/V3 (lines 5 and 6). Therefore player 3 has an incentive to hold his or her switch S3 closed, and thus rely upon player 4 to rescue him or her rather than upon player 1.

If player 3 does relay on player 4 to rescue him or her, and player 4 does so, then player 1 better not intervene by opening his or her switch S1 in an attempt to prevent diversion of the attack from player 3 to player 2 (see line 14), because if he or she does then he or she will also come under attack (line 6) along player 3.

Concerted Attack By Opposite Pair: When oppositely positioned players attack in concert, the remaining pair of oppositely positioned players *both* come under attack; i.e. S1 and S3 together attack L2/V2 (line 11) and L4/V4, while S2 and S4 together attack L1/V1 and L3/V3 (line 6).

Counterattack: Either of the attacked players alone can divert the attack to one of the original aggressors by operating his or her switch; for example, if S1 and S3 attack L2/V2 and S4/V4 (line 11), player 2 by operating his or her switch S2 can divert the attack to player 3 (line 15), or player 4 by operating his or her switch S4 can divert the attack to player 1.

If both players 2 and 4 respond simultaneously, however, line 16 shows that they merely terminate the attack, and do not divert it to either of the original aggressors. Therefore there is an incentive for the two original victims to cooperate with each other. But if each one waits for the other to act, both will get wet.

Reverse Mode: Turret Opposite to Home Position

In the reverse mode the same pairs of valves V and lights L as before are addressed, but the lights L are rotated 180 degrees out of home position, so that they are out of correspondence with the simultaneously addressed valves V, and therefore warn players other than those being attacked. Thus the players must cooperate with each other in teams of oppositely positioned pairs. In the discussion which follows, the lights L will be given double designations indicating, first, where the light was before rotation of the turret, and, second, where it is positioned after rotation. Thus light L3 becomes L3,1.

In addition, the switches S are rotated 180 degrees out of correspondence with the valves V which they address. This is handled for purposes of the present description by simply relabeling the switches. Thus the switch which finds itself in front of player position 1 after rotation is now redesignated S1′, regardless of where it came from.

For the purposes of the following discussion, the reader should use the labels at the *bottom* of the overall truth table.

Single Attack: In this mode each player acting along can attack only the next "lower" numbered position; i.e. S1′ addresses L4,2/V4 (see line 9 of the truth table), S2′ addresses L1,3/V1 (see line 5), S3′ addresses L2,4/V2 (line 3), and S4 addresses L3,1/V3 (line 2). ("Lower" is used here in a "ring counter" sense. The down-count is modulo four with no carries to a lower power of the base four; therefore after one the next "lower" count is four, and the cycle is endlessly recapitulated.)

Abort: When S1 is addressing L4,2/V4, then light L2 warns player 2 (player 4's teammate) rather than the attacked player 4 personally (truth table line 9). Therefore player 4 must rely on his or her teammate, player 2, to defend him or her, which the latter can ordinarily do by actuating his or her (player 2's) switch S2′ (truth table line 13) to divert the attack to player 1. But if player 4 forgets that he or she must rely on his or her teammate, and attempts to defend by actuating his or her switch S4′, this attempt will not only be ineffective in any case (truth table lines 10 and 14), but in addition player 4 will thereby defeat player 2's attempt to defend player 4 (truth table line 14)! If player 4 does this, then player 2 must quickly shout to player 4 that the latter is under attack, and player 4 then must release his or her switch S4′ quickly enough to permit player 2 to abort the spray by operating his or her switch S2′. In this operating mode more reaction time must be allowed, for example about 1.2 to 1.5 seconds, so that the victim's reaction time can be accommodated. This interval, as previously noted, is determined by potentiometers P1 through P4.

Counterattack: When S1′ is attacking L4,2/V4, player 4 cannot counterattack by actuating his or her switch S4′ because line 10 of the truth table shows that V4 continues to be addressed when S1′ and S4′ are closed and S2′ and S3′ are open. In general, whenever player X attacks player X−1, the latter acting alone cannot counterattack.

Any counterattack must come from player 4's teammate, player 2. The attack is diverted to player 1, the original aggressor, when player 2 actuates his or her switch S2′ concurrently with switch S1′ (see line 13).

Abort: Player 1 then can only defend by releasing his or her switch S1′.

Counterattack: In order to counterattack, it is not enough for player 3 to operate S3′, because valve V1 remains addressed (line 15); and it is not enough for player 1 to release S1′, because line 5 shows that here again valve V1 still remains addressed. It is necessary for *both* of these measures to be taken concurrently (see line 7), whereupon the attack is rediverted to L2,4/V2.

Player 2 cannot escape from this situation by himself, because if he or she releases S2′ then line 3 shows the valve V2 remains addressed. It is necessary for him or her to release S2′ *and* for his or her teammate, player 4, to operate S4′, whereupon the attack is diverted to player 3 on the opposing team. The reshuffling of combinations thus continues in pairs.

Electronic Selection Of Rules

The result of the physical rotation of turret 14, as described above, is to select a different set of rules by which the game of this invention is played. The same result, selection of one among a plurality of alternative sets of game rules, may also be achieved by electronic switching. The electronic switching approach avoids the need for any physical rotation of the game apparatus (e.g. turret 14) and the need for any electrical and/or fluid commutators.

Figure 5:
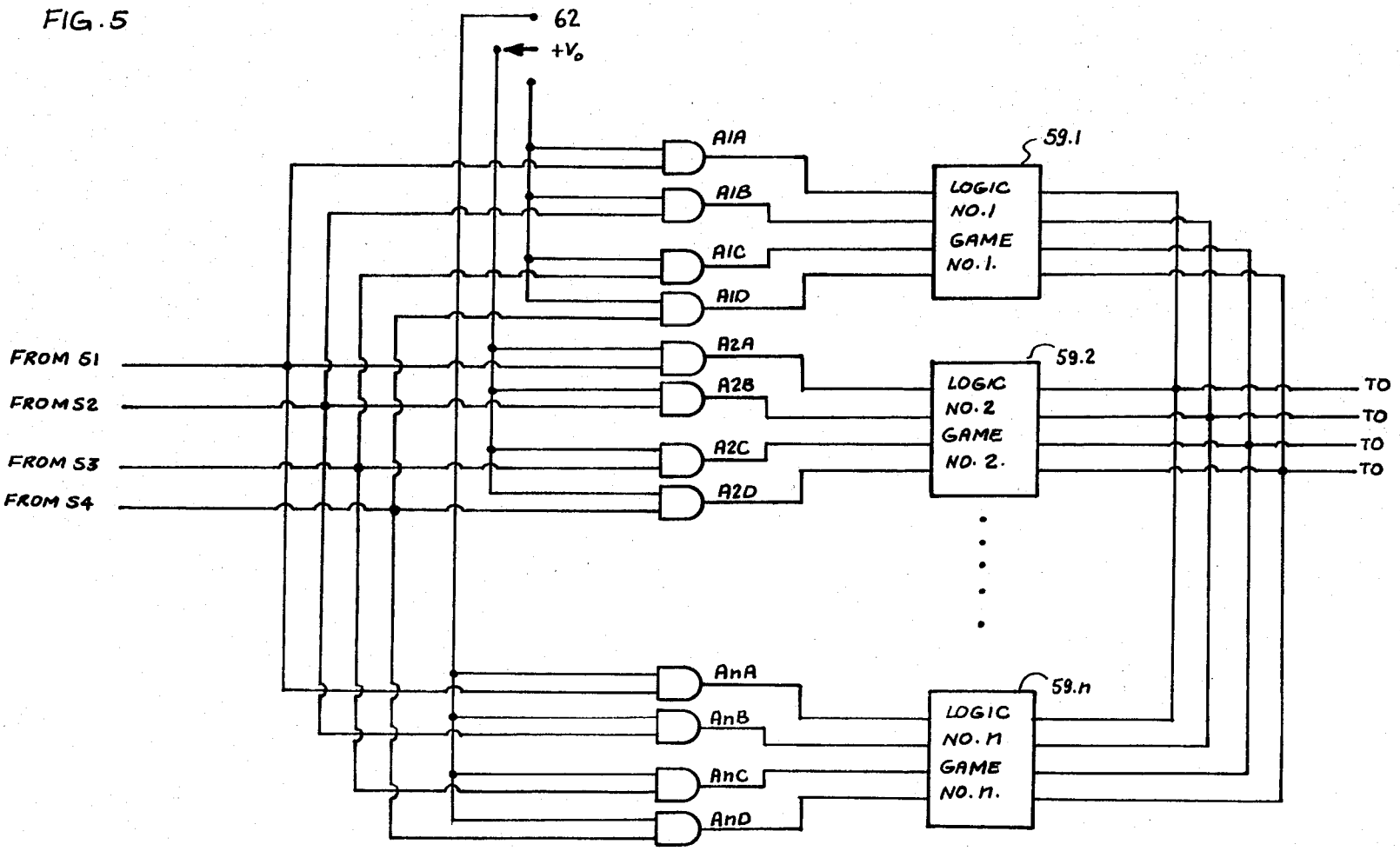
FIG. 5 is a schematic logic and block diagram of the circuit of an alternative form of the game in which "rotation" (selection among alternative rule-determining logic arrangements) is accomplished by electronic switching instead of by physical rearrangement of the game apparatus.

The electronic switching circuitry for an alternative embodiment of the present game which incorporates this electronic switching feature is illustrated in FIG. 5. In describing this embodiment it will be assumed that the electrical and mechanical hardware associated with the circuitry of FIG. 5 is similar to that described above, except that in this instance it is not necessary for the turret 14 to be rotatable.

The game-rule-determining logic for playing the straight version of the above-described game is incorporated into circuit 59.1, which corresponds to circuit 59 of FIG. 4 when turret 14 is in its home position. The game-rule-determining logic for playing the rotated version of the above-described game is incorporated into circuit 59.2, which corresponds to circuit 59 of FIG. 4 when turret 14 is in its rotated position. In addition there may be any desired number of other game-rule-determining logic circuits with reference numerals through 59.n. There are four output lines from each of the game-rule-determining logic circuits 59.1 through 59.n, leading to nand gates N1 through N4 respectively of FIG. 4.

Only one of the game-rule-determing logic circuits 59.1 through 59.n can be employed at any one time. There are four input lines, from switches S1 through S4 respectively of FIG. 4, coming into each of the logic circuits 59.1 through 59.n. These input lines are gated by groups of four AND gates A1A–A1D through AnA–AnD respectively. When the first group of AND gates A1A–A1D is enabled, then logic circuit 59.1 is employed; similarly gates A2A–A2D must be enabled in order to employ logic circuit 59.2; and so on for all the other groups of gates.

A manually operable game rule selection switch 62 is connected to apply a positive voltage to a selected one of the groups of AND gates A1A–A1D through AnA–AnD. The AND gates of the selected group are all enabled by the positive voltage supplied from the game rule selection switch 62, and thus permit the signals coming from switch S1–S4 to reach the one of the logic circuits 59.1 through 59.n which corresponds to the selected group of gates. Then that logic circuit determines the rules of the game, while the other logic circuits are unused until the position of the selector switch 62 is changed.

CONCLUSION

Thus it will now be appreciated that the present game presents a rich variety of features and operating modes which make it unique and enjoyable as well as a cooling outdoor exercise for both adults and children in hot weather. The game focusses especially on the faculties of reaction time, cooperation, and strategic thinking under competitive pressure.

The foregoing detailed description specifies embodiments which are presently preferred, and which serve to illustrate this invention. But other embodiments may be imagined now or in the future which may incorporate one or more aspects of the invention. Therefore the scope of the protection accorded to this invention should not be limited to the particulars of this description, but instead should be determined by the following claims. These claims, moreover, should be interpreted consistently with the general principles and novel teachings expressed herein.

The invention claimed is:

1. A game adapted to be played by at least one player; said game comprising:

a housing; indicator means for displaying game information to said player;

means for ejecting fluid toward a player;

means arranged to determine a set of game rules, said game-rule-determining means including logic means operable to control said indicator means;

manually operable means adapted to be actuated by said at least one player, acting in response to said game information for sending information to said logic means according to said game rules; wherein said manually operable means may comprise a switch means at each of a plurality of player locations;

said logic means being arranged to cause said ejecting means to eject fluid toward said player when said player fails to activate said manually operable means according to said game rules;

said means for ejecting fluid including an ejection valve at each of a plurality of player positions;

means to warn, attack, and defend each player position, wherein said means to attack is ejection of fluid;

said housing rotatably secured such that the means to warn can be aligned with a different player position than the position under attack.

2. A game as in claim 1 wherein said game-rule-determining means includes a delayed attack signal to which a player must respond by also attacking.

3. A game as in claim 1 further comprising:

means arranged to determine a second set of game rules, said second game-rule-determining means including logic means operable to control said indicator means;

and manually operable means for selecting one of said game-rule-determining means to be operatively connected to said indicator means and said manually operable information sending means;

said logic means of said second game-rule-determining means being arranged to cause said ejecting means to eject fluid toward said player when said player fails to activate said manually operable means according to said second set of game rules.

4. A game as in claim 1 comprising at least three of said player positions angularly displaced from each other and each having a respective attacking means, delay interval means, switch means, and warning means;

said game being arranged so that said warning means and attacking means are rotatable through an angular displacement of at least one player position relative to each other without disrupting the operating relationships between said warning means and said switching means, whereby said warning may be directed toward a different player position than said attack.

5. A game as in claim 1 further comprising:

at least one means operable to initiate a delay interval upon receiving an attack signal, and thereafter to send a delayed attack signal to said attacking means at the end of said delay interval;

at least first switch means positioned to be operated by an attacking player located at said attacking position;

means operable in response to actuation of said first switch means for sending an attack signal to said one delay interval means;

means responsive to said attack signal and adapted and positioned to warn said defending player at said defending position of the impending attack;

second switch means positioned to be operated by said defending player at said defending position;

and means for disabling said attacking means, said disabling means being operable in response to actuation of said second switch means, whereby said attack is aborted if said second switch means is actuated before the expiration of said delay interval.

6. A game adapted to be played by a plurality of players located at respective different positions, including at least one attacking position, at least one defending position, and at least one additional position, said game comprising:

at least two attacking means, a first one of which is positioned for attacking said defending player located at said defending position upon receiving an attack signal, and a second one of which is positioned for attacking an additional player located at said additional position upon receiving said attack signal;

a housing;

means for ejecting fluid toward a player;

said means for ejecting fluid including an ejection valve at each of a pluraliy of player positions;

means to warn, attack, and defend each player position, wherein said means to attack is ejection of fluid;

said housing rotatably secured such that the means to warn can be aligned with a different player position than the position under attack.

7. A game as in claim 6 further comprising:

alternative logic means arranged for routing said attack signal to a different one of said attacking means, as compared to said first-mentioned logic means, in response to operation of said switch means;

and manually operable means for selecting one of said logic means to be operatively connected to said attacking means and said switch means.

8. A game as in claim 6 adapted to be played by at least first through fourth players located at first through fourth positions respectively; said game comprising:

at least first through fourth attacking means arranged for attacking said first through fourth players respectively at said first through fourth positions respectively in response to an attack signal;

at least first through fourth switch means arranged to send said attack signal and positioned to be operated by said first through fourth players respectively located at said first through fourth positions respectively;

said logic means being arranged for routing said attack signal to said attacking means in response to operation of said switch means;

said logic means being further arranged so that any player who is under attack by two adjacent players is required to cooperate with the fourth player to terminate the attack or divert it from himself to one of the original attackers.

9. A game as in claim 8 wherein said logic means is so arranged that the Boolean conditions for operating said attacking means to attack said first through fourth players 1 through 4 respectively by means of said first through fourth switches S1 through S4 respectively are:

1=not S1, not S3, S4+not S2, S3, S4

2=S1, not S3, S4+S1, not S2, not S4

3=not S1, S2, not S3+S1, S2, not S4

4=not S1, S2, S3+not S2, S3, not S4.

10. A game as in claim 8 wherein said positions are angularly displaced from each other and said game is arranged so that said warning means and attacking means are rotatable through an angular displacement of at least two player positions relative to each other without disrupting the operating relationships between said warning means and said switching means, whereby said warning may be directed toward a different player position than said attack.

11. A game as in claim 6 further comprising:

means, for each said attacking means, operable to initiate a delay interval and thereafter to send a delayed attack signal to its respective attacking means at the end of said delay interval;

each of said delay interval means being connected to initiate its respective delay interval in response to the attack signal for its respective attacking means;

means responsive to said attack signal and positioned to warn the player at the position which is under attack, by the attacking means corresponding to said attack signal, of the impending attack;

and respective aborting means for disabling each of said attacking means, said aborting means being operable in response to actuation of the respective switch means corresponding to said attacking means, whereby said attack is aborted if said switch means is actuated before the expiration of said delay interval.

12. A game as in claim 11 wherein said positions are angularly displaced from each other and said game is arranged so that said warning means and attacking means are rotatable through an angular displacement of at least one player position relative to each other without disrupting the operating relationships between said warning means and said switching means, whereby said warning may be directed toward a different player position than said attack.

13. A game as in claim 6 further comprising:

first switch means positioned to be operated by said attacking player located at said attacking position;

logic means for routing said attack signal to said first attacking means in response to operation of only said first switch means whereby to attack said defending player at said defending position;

and second switch means positioned to be operated by said defining player at said defending position;

said logic means being arranged to divert said actuating signal from said first to said second attacking means in response to concurrent actuation of said first and second switch means, whereby said attack is diverted from said defending position to said additional position when said second switch means is actuated.

* * * * *